United States Patent [19]

King

[11] 4,403,616

[45] Sep. 13, 1983

[54] EXPIRATORY BREATHING EXERCISE DEVICE

[75] Inventor: George E. King, Barrington, R.I.

[73] Assignee: K-Med, Inc., Flemington, N.J.

[21] Appl. No.: 271,984

[22] Filed: Jun. 9, 1981

[51] Int. Cl.[3] ..... A63B 23/00

[52] U.S. Cl. ..... 128/725; 272/99

[58] Field of Search ..... 128/720, 725, 726, 727, 128/728, 729; 272/99; 73/861.57

[56] References Cited

U.S. PATENT DOCUMENTS

| | | | |
|---|---|---|---|
| 3,133,440 | 5/1964 | Conkling | 73/861.57 |
| 3,416,371 | 12/1968 | Locke | 73/861.57 |
| 3,635,214 | 1/1972 | Rand et al. | 272/99 |
| 3,695,608 | 10/1972 | Hanson | 272/99 |
| 3,822,699 | 7/1974 | Cleary | 128/727 |
| 3,848,585 | 11/1974 | Otsap et al. | 128/727 |
| 4,158,360 | 6/1979 | Adams | 272/99 |
| 4,183,361 | 1/1980 | Russo | 128/725 |

*Primary Examiner*—Lee S. Cohen

*Assistant Examiner*—Harry J. Macey

*Attorney, Agent, or Firm*—Larson and Taylor

[57] ABSTRACT

A breathing exercise device which promotes proper resistance breathing for a user is disclosed. The device includes a substantially enclosed elongate air flow column which is disposed vertically and which has a cross-sectional interior dimension which increases in size upwardly in graduated increments. An air inlet is provided adjacent the bottom of the air flow column and at least one air outlet is located above this air inlet. The user exhales through a tube which is connected to the air inlet and causes an air flotation element movably disposed in the air flow column to be lifted in the column. The air flotation element is sized so as to fit relatively closely within the column so that a given exhalation effort causes the flotation element to stabilize at a position in the column relative to the cross-sectional dimension which corresponds to the given exhalation rate of air flow through the column. The air flotation element is visible by the user through the air outlet.

3 Claims, 4 Drawing Figures

EXPIRATORY BREATHING EXERCISE DEVICE

FIELD OF THE INVENTION

The present invention relates generally to the field of breathing exercise devices and more particularly to expiratory breathing exercise devices which promote proper resistance breathing by the user.

BACKGROUND OF THE INVENTION

It is well known that patients with chronic obstructive pulmonary disease (COPD) such as emphysema, asthma, and bronchitis have limited expiratory flow and force. These patients have their airways and alveoli either partially destroyed or obstructed so that they experience great difficulty in exhaling entrapped air due to their impaired respiratory tissues. For this reason, various medical techniques or teaching methods have been developed to encourage proper expiratory maneuvers and to improve respiratory musculature. One basic technique is to instruct the patient to blow against a slight restriction or resistance. This method is commonly termed pursed lip breathing and has been found most beneficial in promoting a full long expiration of entrapped air. Various other primitive devices such as exhaling through a straw or blowing up balloons have also been used.

As the result of the limited success of the various primitive devices, a device called "blow bottles" was developed. This device consisted of two bottles locates side by side with tubings and caps attached to each bottle. One bottle was filled with water and the patient was instructed to forcibly blow into the bottle to transfer the liquid over to the second bottle. Blow bottles offered an advantage over the primitive devices in that the transfer of water acted as an incentive for exercise. However, blow bottles were often found to offer too much resistance and provided a large back pressure. Consequently, patients often became weakened, tired, and discouraged. Additionally, blow bottles were cumbersome, hard to fill and unfill, tipped easily, and were generally considered messy.

In order to avoid the problems associated with blow bottles, a device was developed which consisted of a chamber to which a length of tubing was connected. Inside the chamber was a lightweight ball. As the patient blew into the tube, the ball would rise providing an incentive. The device also had a cap with holes in it which could be used to increase expiratory effort and thus provide an increased incentive. Unfortunately, this device had several severe limitations. For example, the chamber became easily fogged due to the moisture in the exhaled air and it thus became very difficult to see the ball in the chamber. This negated the incentive provided by the rising ball. The rising ball would also frequently rise to the top of the chamber blocking off the top outtake holes and thus restricting flow through the device. In addition, the device did not give an accurate readout of expiratory flow or force being provided. It only indicated a predetermined flow even though the patient may very well have exceeded that range.

A serious shortcoming of the prior art devices discussed above was the fact that the patient's air flow rate had to increase if a corresponding increase in resistance force was desired. However, it is extremely desirable to keep the expiratory air flow rate relatively low, constant, and visibly measurable during exercise even though an increased resistance force is desired. If the flow rate is kept low, then the patient can maintain the desired long sustained exhaled breath against the fixed resistance force.

Thus, there exists in the medical field a need for a simple, inexpensive single patient use device which can measure the expiratory flow and resistance force of patients. This information can then be used to prescribe therapy such as aerosol medication more accurately. The need to provide an incentive to exercise damaged airways and expiratory musculature by the desired pursed lip type of breathing is also evident from the prior art.

In U.S. Pat. No. 4,183,361 (Russo), an inhalation exercising device is disclosed. This device includes an elongate column having a cross sectional dimension which increases in size in graduated increments through which air is drawn. An air flotation element is located within the column which rises in the column to a height corresponding to a given inhalation effort.

The use of a column having a cross sectional dimension which increases in increments has also been disclosed in the prior art in connection with flow meters. Examples of such flow meters are disclosed in U.S. Pat. No. 2,827,008 (Hodge) and U.S. Pat. No. 3,416,371 (Locke). In addition, a flow meter column having a gradually increasing cross sectional dimension is also disclosed in U.S. Pat. No. 2,099,842 (Connell).

SUMMARY OF THE INVENTION

In accordance with the present invention, an expiratory breathing exercise device is provided with a substantially enclosed elongate air flow column disposed in a generally vertical orientation. The air flow column has a cross-sectional interior dimension which increases in size upwardly in graduated increments. An air inlet is located in the column adjacent the bottom thereof and at least one air outlet is also located in the column above the air inlet. A connecting means fluidly connects the air inlet to the mouth of the user so that air expired from the user enters the column through the inlet. An air flotation element is movably disposed in the column so as to be lifted in the column by the air flowing through the inlet. The air flotation element is sized so as to fit relatively closely within the air flow column so that a given exhalation effort of the user causes the air flotation element to stabilize at a position in the air flow column relative to the cross-sectional dimension which corresponds to a given exhalation rate of air flow through the column. The air flotation element is also visible to the user through the air outlet so as to provide an incentive.

According to a preferred embodiment, the air inlet is also provided with a restriction means such as a plurality of plugs having different sized orifices. The plugs are interchangeably insertable into the air inlet so as to alter the resistance to air flow through the connecting means and into the column. By using an appropriate plug, the user maintains a desired flow rate which is indicated by the air flotation element in the column even though the resistance to the flow has changed. Preferably, the interior of the plugs are funnel shaped in the direction of flow so that a smooth, non-turbulent flow of air enters the column. A removable top is also provided on the column so that the air flotation element and interior of the column can be easily cleaned. In the preferred embodiment, the column includes three increments and two air outlets which are located at the junction of each pair of adjacent increments. The uppermost air outlet is significantly larger than the other air outlet.

OBJECTS OF THE INVENTION

It is an object of the invention to provide a simple and easy readout of expired air flow rates. It is a further object of the invention to provide accurate measurable exhalation air flow and force rates while simultaneously providing exercise to respiratory airways and musculature. It is another object of the invention to provide accurate air flow rates so that proper therapy such as aerosols or broncho dilators can be prescribed.

It is an important object of the invention to provide low and constant expiratory air flow rates while varying the resistance force. Another important object of the invention is to provide an exercise breathing device which does not inhibit or restrict air flow and which does not excessively tire the patient.

It is yet another object of the invention to provide an exercise breathing device which has a clearly visible readout of expiratory rates which is not affected by fogging of the device. It is a further object of the invention to provide an exercise breathing device which is easily cleaned after use.

A still further object of the present invention is to provide an exercise breathing device which may be inexpensively manufactured and maintained.

Other objects, features, and advantages of the present invention are stated in or apparent from the detailed description of a presently preferred embodiment of the invention found hereinbelow.

DETAILED DESCRIPTION OF THE PREFERRED EMBODIMENT

Figure 1:
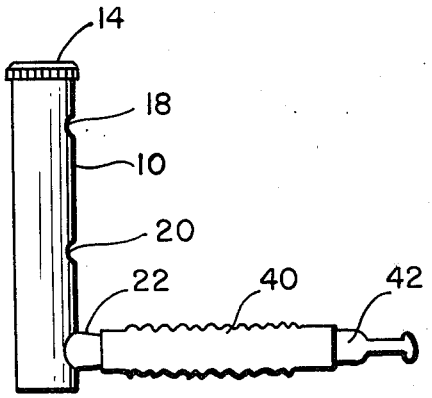
FIG. 1 is a side elevational view of the expiratory breathing exercise device of the present invention.

With reference now to the drawings in which like numerals represent like elements throughout the several views, a presently preferred embodiment of the present invention is depicted in FIGS. 1 to 4 and comprises an air flow column 10 having a generally cylindrical exterior shape. Air flow column 10 is preferably injection molded in one piece of an opaque rigid thermoplastic such as high impact styrene, styrene acrylic nitrile, or other rigid material. Bottom 12 of air flow column 10 is integrally formed therewith while the top of air flow column 10 is closed by a cap 14 which frictionally engages air flow column 10. As shown best in FIG. 4, air flow column 10 has a cross-sectional interior dimension which increases in size upwardly in graduated increments over the length thereof. For convenience, the graduated increments will be referred to as segments 16*a*, 16*b*, and 16*c*. Located at the juncture of segments 16*a* and 16*b* is an orifice 18, and located at the juncture of segments 16*b* and 16*c* is an orifice 20. As shown, orifice 18 is significantly larger than orifice 20. Also integrally formed with air flow column 10 adjacent bottom 12 is a laterally projecting tube fitting 22.

Located within air flow column 10 is an air flotation element such as ball 24. Ball 24 is made of a lightweight material such as polyethylene and is sized to fit relatively closely within air column 10. Two integrally formed projections 26 and 26' extend inwardly from opposite sides of segment 16*c* of air flow column 10. Projections 26 and 26' hold ball 24 above the opening of tube fitting 22.

Figure 2:
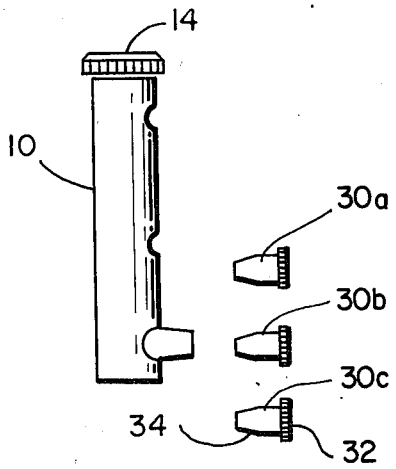
FIG. 2 is a side elevational view of the air flow column depicted in FIG. 1 showing three plugs insertable therein.
Figure 4:
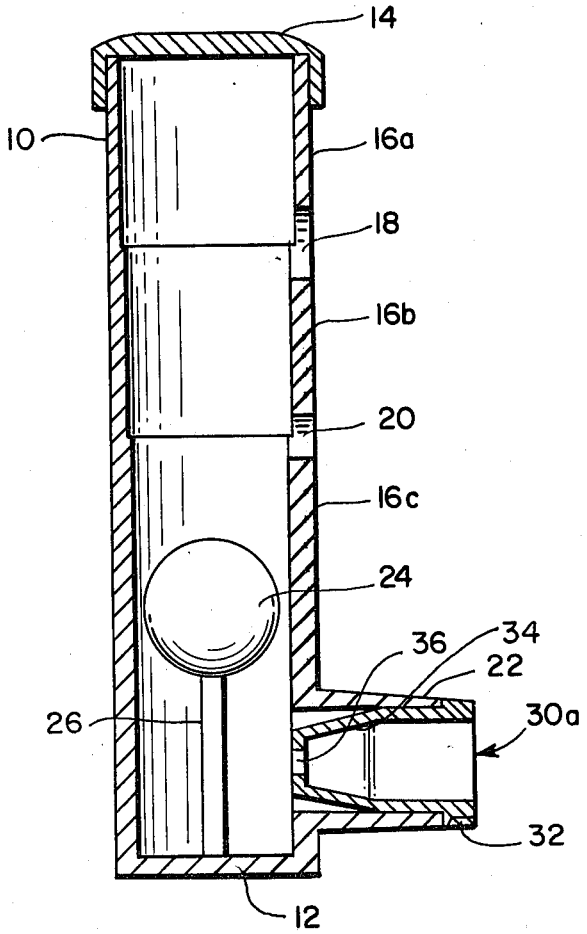
FIG. 4 is a cross-sectional side elevation view of the air flow column depicted in FIG. 3 taken along the line 4—4.

As shown best in FIG. 4, a plug 30*a* having a knurled flange 32 is insertable in tube fitting 22. Plug 30*a* is hollow and is frictionally held in tube fitting 22. The end of plug 30*a* which is closest to air column 10 has a funnel shaped portion 34 and a metered orifice 36. Preferably, as shown in FIG. 2, the breathing exercise device of the present invention is provided with three plugs 30*a*, 30*b*, and 30*c* which are interchangeably insertable into tube fitting 22. The various plugs 30*a*, 30*b*, and 30*c* are substantially identical except that the size of metered orifice 36 is different for each plug 30*a*, 30*b*, and 30*c*.

One end of a convolute tubing 40 is attached to tube fitting 22 over knurled knob 32 of plug 30 as shown in FIG. 1. At the other end of tube 40 is a mouthpiece 42 which is shaped so as to enhance the pursed lip breathing technique as the user breathes into mouthpiece 42.

The operation of the breathing exercise device of the present invention is as follows. After the breathing exercise device is assembled as depicted in FIG. 1 with a suitable plug 30*a*, 30*b*, or 30*c* inserted in tube fitting 22, air column 10 is hand held by the user and mouthpiece 42 is inserted in the mouth of the user. After making sure that orifices 18 and 20 are not obstructed, the user proceeds to exhale into mouthpiece 42. The air exhaled into mouthpiece 42 travels through convolute tube 40 into a suitable plug such as plug 30*a*. The air then passes along funnel shaped portion 34 and through metered orifice 36 into segment 16*c* of air flow column 10. Funnel shaped portion 34 channels air into segment 16*c* in a smooth, non-turbulent flow. The size of metered orifice 36 determines the resistance to air flow which the user encounters. Once the air enters segment 16*c*, the air travels upward and carries ball 24 along. Ball 24 rises to a level which matches up with either orifice 20 or orifice 18 depending upon the flow of exhaled air. Due to the increased diameter of segment 16*a* over segment 16*b* and the increased size of orifice 18 over orifice 20, a greater air flow is required in air column 10 to raise ball 24 to a position opposite orifice 18 than is required to raise ball 24 to a position opposite orifice 20. For convenience, ball 24 is provided with a light color so that it can be easily seen through orifice 18 or 20. Thus, the visibility of ball 24 in either orifice 18 or 20 acts as an incentive to the user to exhale and raise ball 24 so as to be visible. It should be noted that orifice 18 is substantially larger than orifice 20 so that even when the user exceeds the desired air flow, the exhaled air will readily travel out of orifice 18 so that there is no further restricting of air flow within air flow column 10. The large size of orifice 18 also prevents ball 24 from rising above orifice 18 and slamming into cap 14. The user continues to exhale into mouthpiece 42 causing ball 24 to rise to orifice 18 or 20 for a period of time determined by the user's physician.

As the condition of the user improves, the physician can direct the user to cause ball 24 to rise to orifice 18 instead of orifice 20 so that the user increases his exhalation flow rate. In addition, the physician can substitute plug 30*b* for plug 30*a*. Plug 30*b* has a smaller metered orifice 36 than plug 30*a* so that the resistance to air flow which causes ball 24 to rise to orifice 20 or 18 is increased. By providing a number of plugs such as plugs 30*a*, 30*b*, and 30*c*, the physician can select the most beneficial and therapeutic plug for the user. For convenience, plugs 30*a*, 30*b* and 30*c* are suitably marked and/or color coded so that the physician can easily recognize which size of metered orifice 36 is present in the plug.

Figure 3:
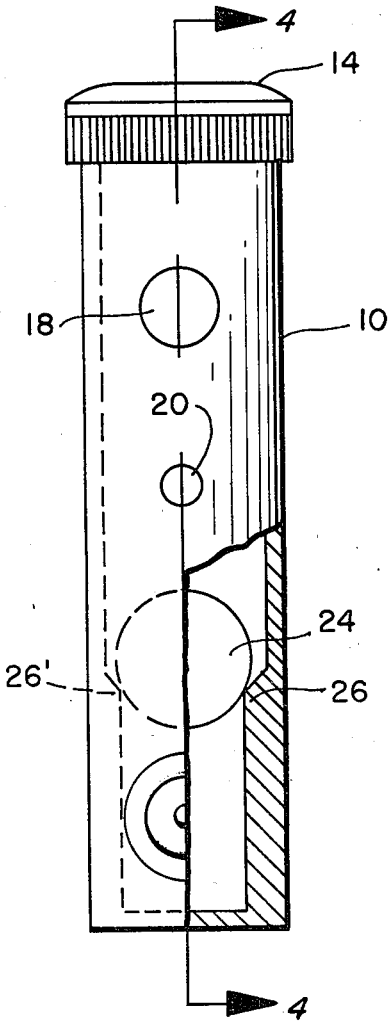
FIG. 3 is a front elevational view in partial cross section of the air flow column depicted in FIG. 1.

By way of example, a suitable expiratory breathing exercise device is constructed as follows. Air flow column 10 is constructed of three segments 16*a*, 16*b* and 16*c* which have inside diameters of 1.070 inches, 1.055 inches, and 1,040 inches, respectively. With this sized air flow column 10, ball 24 is preferably provided with an outside diameter of 1.000 inches with a tolerance of 1.000 inches to 1.015 inches. By molding ball 24 from a material such as polyethylene, ball 24 can be provided with a weight of preferably 1.5 grams with a tolerance of 1.35 grams to 1.75 grams. Orifices 18 and 20 are then provided with inside diameters of 0.500 inches and 0.250 inches, respectively. With these dimensions, the flow of air through air flow column 10 sufficient to raise ball 24 to be visible in orifice 20 is 150 cubic centimeters per second. Similarly, the rate of air flow through air flow column 10 sufficient to raise ball 24 so as to be seen in orifice 18 is 350 cubic centimeters per second. These air flow rates are preferably marked on the outside of air flow column 10 adjacent orifices 18 and 20 as depicted in FIG. 3. Tube fitting 22 is conveniently provided with an outside diameter which is sufficient to hold a convolute tubing 40 having an inside diameter of 22 millimeters and an inside diameter of 0.720 inches. Plugs 30*a*, 30*b*, 30*c* have an outside diameter which is also 0.720 inches so as to fit snugly within the tube fitting 22. Plugs 30*a*, 30*b*, and 30*c* also are provided with an inside diameter of 0.600 inches prior to funnel shaped portion 34. With an expiratory breathing exercise device constructed according to the above dimensions, the following table shows the resistance force or back pressure to the patient's lungs as a function of the inside diameter of metered orifice 36 provided in plugs 30*a*, 30*b*, and 30*c*:

| I.D. (inches) of Metered Orifice 36 | Air Flow Rate (cc/sec) | Resistance Force (mm Hg) |
|---|---|---|
| .220 | 150 | 2 |
| | 350 | 4 |
| .156 | 150 | 5 |
| | 350 | 10 |
| .125 | 150 | 15 |
| | 350 | 20 |

As shown in the table, resistance force increases as a function of the inside diameter of metered orifice 36 even though a constant level of air flow is provided. Thus, the smaller the metered orifice 19 is, the higher the resistance force or therapeutic back pressure to the user's lungs. By providing precalibrated plugs 30*a*, 30*b*, and 30*c*, and physician merely selects the appropriate plug for the patient's needs. Conveniently, plugs 30*a*, 30*b*, and 30*c* are identical except for metered orifice 36 and are injection molded of one piece typically from a rigid thermoplastic such as nylon or polyproplene. Cap 14 can also be made of a similar material.

It should be appreciated that with the present invention, ball 24 always remains free floating and suspended during exercise. However, ball 24 cannot suddenly block air flow through air flow column 10 which might be harmful to the patient. It should also be appreciated that even though plugs 30*a*, 30*b*, and 30*c* are removable by the physician, the plug in tube fitting 22 is covered by tubing 40 so that the patient is less likely to see the plug or disturb it. In addition, most of the plug is received within tube fitting 22 so that the patient cannot squeeze or manipulate the plug and possibly produce an undesirable level of resistance.

Although the invention has been described with air flow column 10 being cylindrically shaped and having a ball 24, it should be appreciated that other cross-sectional configurations such as square or triangular can also be used with correspondingly configured air flotation elements. In addition, instead of using a plurality of plugs to restrict air flow into air column 10, a calibrated valve mechanism could be substituted therefor. Thus while the invention has been described in detail with respect to an exemplary embodiment thereof, it will be understood by those of ordinary skill in the art that these and other variations and modifications may be affected in the exemplary embodiment within the scope and spirit of the invention.

I claim:

1. An expiratory breathing exercise device comprising:

a substantially enclosed elongate air flow column disposed longitudinally in a generally vertical orientation, said air flow column having a horizontal cross-sectional interior dimension which increases in size upwardly in graduated increments over the length of said column;

an air inlet located in said column adjacent the bottom thereof;

connecting means for fluidly connecting said air inlet to the mouth of the user so that air expired from the user enters said column through said air inlet;

at least one air outlet located in said column above said air inlet through which expired air entering said air inlet is exhausted from said column;

an air flotation element movably disposed in said column so as to be lifted in said column by the blowing of air into said column with sufficient force by the user, said air flotation element being sized so as to fit relatively closely within said air flow column such that due to the increase in cross-sectional dimension of said column in increments, a given exhalation effort of the user causes said air flotation element to stabilize at a position in said air flow column relative to the cross-sectional dimension which corresponds to a given exhalation rate of air flow through said column and at a position where said air flotation element is visible to the user through said at least one air outlet; and restriction means for altering the resistance to air flow through said connecting means and into said column whereby the effort expended by the user in the raising of said air flotation element to a predetermined position in said column is increased as the resistance to air flow increases, said restriction means comprising a plurality of plugs having differing sized orifices, said plugs being interchangably insertable into said air inlet, the interior of said plugs being funnel shaped in the direction of flow so that a smooth non-turbulent flow of air enters said column.

2. An expiratory breathing exercise device comprising:

a substantially enclosed elongate air flow column disposed longitudinally in a generally vertical orientation, said air flow column having a horizontal cross-sectional interior dimension which increases in size upwardly in graduated increments over the length of said column;

an air inlet located in said column adjacent the bottom thereof;

connecting means for fluidly connecting said air inlet to the mouth of the user so that air expired from the user enters said column through said air inlet;

one air outlet located at the junction of each pair of adjacent increments and;

an air flotation element movably disposed in said column so as to be lifted in said column by the blowing of air into said column with sufficient force by the user, said air flotation element being sized so as to fit relatively closely within said air flow column such that due to the increase in cross-sectional dimension of said column in increments, a given exhalation effort of the user causes said air flotation element to stabilize at a position in said air flow column relative to the cross-sectional dimension which corresponds to a given exhalation rate of air flow through said column and at a position where said air flotation element is visible to the user through said at least one air outlet.

3. An expiratory breathing exercise device as claimed in claim 2 wherein there are three increments in said column and two air outlets, the uppermost air outlet being significantly larger than the other air outlet.

* * * * *